US010722054B2

(12) United States Patent
Staton

(10) Patent No.: US 10,722,054 B2
(45) Date of Patent: Jul. 28, 2020

(54) NECK PILLOWCASE

(71) Applicant: Pleasants Olivia Staton, Los Angeles, CA (US)

(72) Inventor: Pleasants Olivia Staton, Los Angeles, CA (US)

(73) Assignee: Pleasants Olivia Staton, Los Angeles, CA (US)

( * ) Notice: Subject to any disclaimer, the term of this patent is extended or adjusted under 35 U.S.C. 154(b) by 135 days.

(21) Appl. No.: 15/963,194

(22) Filed: Apr. 26, 2018

(65) Prior Publication Data

US 2018/0310731 A1 Nov. 1, 2018

Related U.S. Application Data

(60) Provisional application No. 62/490,750, filed on Apr. 27, 2017.

(51) Int. Cl.

| | |
|---|---|
| ***A47G 9/10*** | (2006.01) |
| ***A47G 9/02*** | (2006.01) |
| ***A47C 7/38*** | (2006.01) |

(52) U.S. Cl.

CPC ..... *A47G 9/0253* (2013.01); *A47C 7/383* (2013.01); *A47G 9/1081* (2013.01)

(58) Field of Classification Search

CPC ..... A47C 7/383; A47G 9/0253; A47G 9/1081

See application file for complete search history.

(56) References Cited

U.S. PATENT DOCUMENTS

| | | | | |
|---|---|---|---|---|
| 8,144,913 | B1 * | 3/2012 | Myles, Jr. | A47C 7/383 381/333 |
| 10,383,465 | B2 * | 8/2019 | Sternlight | A47C 7/383 |
| 2014/0007351 | A1 * | 1/2014 | Cohen | A47G 9/10 5/639 |
| 2017/0280902 | A1 * | 10/2017 | Chan | A47C 7/383 |

OTHER PUBLICATIONS

Evolution Pillow Youtube.com video; Mattress Clarity; https://www.youtube.com/watch?v=-OJO3rYNiGg; published Sep. 19, 2016. (Year: 2016).*

* cited by examiner

*Primary Examiner* — Daniel J Colilla

(57) ABSTRACT

Disclosed is an improved neck pillowcase for a neck pillow. The neck pillowcase includes a top fabric layer, an intermediate fabric layer, a bottom fabric layer, wherein the top fabric layer and the bottom fabric layer are joined together with the intermediate fabric layer at two perimeter edges of the intermediate fabric layer to form a body portion, two side arms, an interior cavity accessible through a first closure means embodied near the body portion of the improved pillowcase. The neck pillowcase further includes one or more pockets configured internally and proximal to the first closure means within the body portion of the improved neck pillowcase for holding one or more objects, and at least one flap configured externally on at least one of the two arms for facilitating portability of the improved neck pillowcase, and holding the one or more objects.

12 Claims, 7 Drawing Sheets

NECK PILLOWCASE

The present application claims the priority benefits of U.S. Provisional Application No. 62/490,750, filed on Apr. 27, 2017, which is incorporated herein by reference in its entirety.

FIELD OF THE INVENTION

The present application generally relates to pillowcases and in particular, it relates to an improved neck pillowcase.

BACKGROUND

Typically pillowcases designed for bed pillows are widely used and known to human for many years. Such pillowcases mainly comprise of two sides of any suitable fabric material sewn together on three sides and open at one side for receiving the bed pillow or the cushion. Such pillowcases beyond receiving the bed pillow or the cushion aren't capable of holding any other object. A few of pillowcases include one or more external pockets with some closure means (e.g. a Zipper or a Velcro®) designed to hold one or more small object such as a phone or any other valuable items.

Traveling from one location to another has become an indispensable part of human life. While travelling in cars or buses or on planes it is difficult for passengers to sleep comfortably. Such travels can result in head and neck of the passenger being placed in uncomfortable positions and may also cause injuries. This has necessitated passenger to carry various types of neck pillows with them during their travel. The neck pillows may be inflatable in nature or may contain some stuffing or padding inside. In either of forms, the neck pillows are often disposed inside neck pillowcases/covers of varied designs. The neck pillowcases when not in use are removed from over the neck pillow and are kept inside the passenger's luggage and many times, people forget to carry it with them when they are in their next schedule of travel. Also, the neck pillowcases are mainly designed to embody or receive the neck pillows; existing neck pillowcases do not provide any increase in the utility for the neck pillows.

Thus, in the light of the above mentioned background art, it is evident that, there is a need for an improved neck pillowcase that would provide increase in the utility for the neck pillows commercially available.

BRIEF SUMMARY

Before the present systems and methods, enablement are described, it is to be understood that this application is not limited to the particular systems, and methodologies described, as there can be multiple possible embodiments which are not expressly illustrated in the present disclosures. It is also to be understood that the terminology used in the description is for the purpose of describing the particular versions or embodiments only, and is not intended to limit the scope of the present application.

An objective of the present invention is to provide an improved neck pillowcase.

Another object of the embodiments of the present invention is to provide a portable neck pillowcase that can be easily carried by passengers during travel.

Another object of the embodiments herein is to provide a combined neck pillowcase with one or more pockets disposed inside the pillowcase for holding various objects.

According to an aspect of the present invention, there is provided an improved neck pillowcase for a neck pillow. The neck pillowcase includes a top fabric layer, an intermediate fabric layer, a bottom fabric layer, wherein the top fabric layer and the bottom fabric layer are joined together with the intermediate fabric layer at two perimeter edges of the intermediate fabric layer to form a body portion, two side arms, an interior cavity accessible through a first closure means embodied near the body portion of the improved pillowcase. The neck pillowcase further includes one or more pockets configured internally and proximal to the first closure means within the body portion of the improved neck pillowcase for holding one or more objects, and at least one flap configured externally on at least one of the two arms for facilitating portability of the improved neck pillowcase, and holding the one or more objects.

The features and advantages described in this summary and in the following detailed description are not all-inclusive, and particularly, many additional features and advantages will be apparent to one of ordinary skill in the relevant art, in view of the drawings, and specification thereof. Moreover, it should be noted that the language used in the specification has been principally selected for readability and instructional purposes, and may not have been selected to delineate or circumscribe the inventive subject matter.

BRIEF DESCRIPTION OF THE DRAWINGS

The foregoing summary, as well as the following detailed description of preferred embodiments, is better understood when read in conjunction with the appended drawings. There is shown in the drawings example embodiments, however, the application is not limited to the specific system and method disclosed in the drawings.

DETAILED DESCRIPTION

Some embodiments, illustrating its features, will now be discussed in detail. The words "comprising," "having," "containing," and "including," and other forms thereof, are intended to be equivalent in meaning and be open ended in that an item or items following any one of these words is not meant to be an exhaustive listing of such item or items, or meant to be limited to only the listed item or items. It must also be noted that as used herein and in the appended claims, the singular forms "a," "an," and "the" include plural references unless the context clearly dictates otherwise.

Although any methods, and systems similar or equivalent to those described herein can be used in the practice or testing of embodiments, the preferred methods, and systems are now described. The disclosed embodiments are merely exemplary.

The various features and embodiments of the improved neck pillowcase 100 are better explained in conjunction with FIGS. 1-7.

Figure 1:
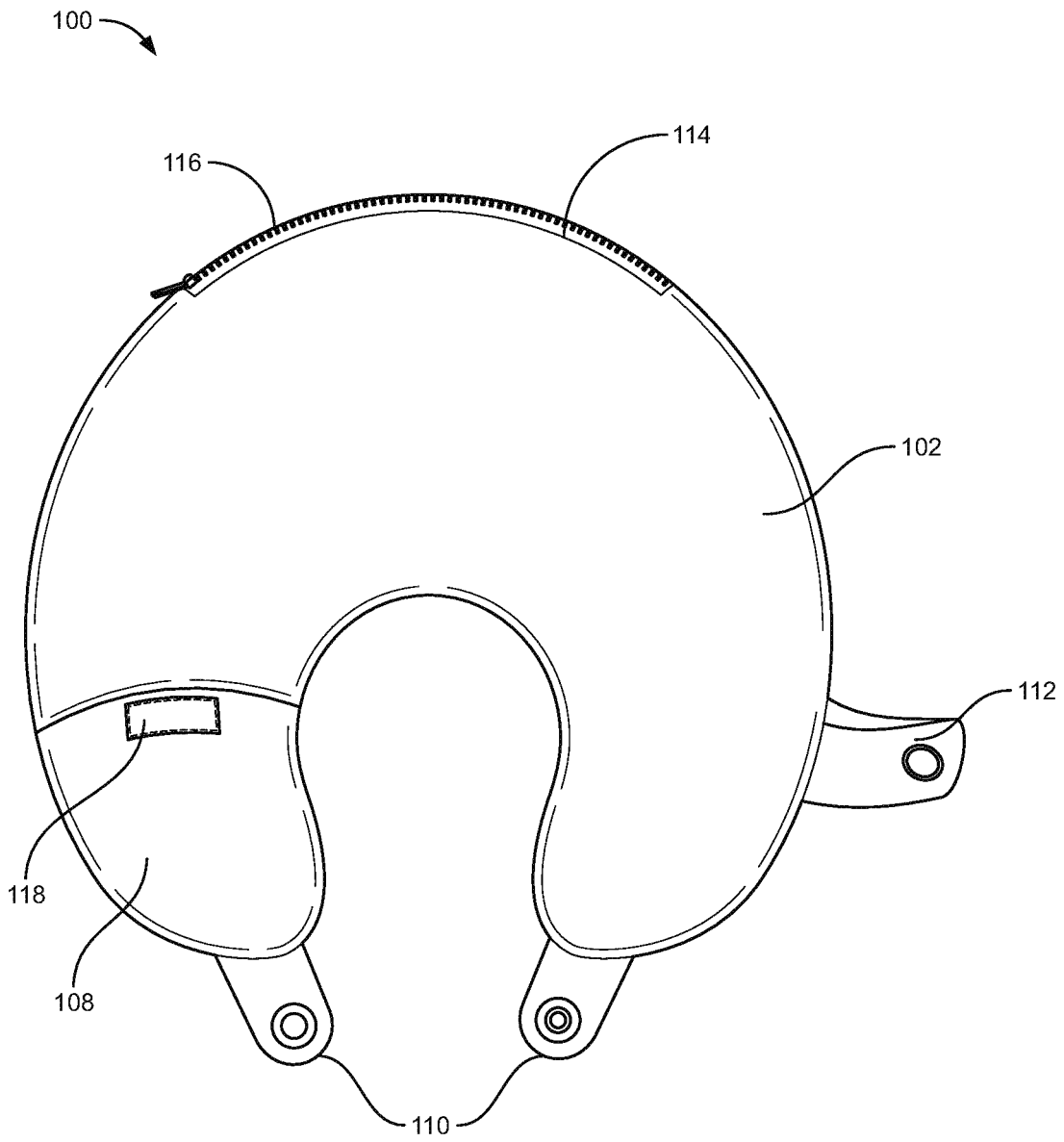
FIG. 1 illustrates a top view of an improved neck pillowcase without a neck pillow inside, in accordance with an exemplary embodiment of the present invention.

Referring to accompanying figures, especially to FIG. 1, the pillowcase 100 includes a top fabric layer 102, a bottom fabric layer 104, and intermediate fabric layer 106 joint preferably sewn together at the perimeter edges to form the pillowcase 100. The shape and dimensions of the top fabric layer 102, the bottom fabric layer 104, and the intermediate fabric layer 106 forming the neck pillowcase 100 are chosen so as to form the neck pillowcase 100 of standard size that can easily accommodate neck pillows or neck cushions commercially available. The top and bottom fabric layers 102, 104 may preferably include but not limited to cotton, polyester, cotton-polyester blend, linen, acrylic, velvet, fleece, silk, rayon, rayon-cotton blend nylon, nylon-cotton blend or any combination thereof. The intermediate fabric layer 106 may be made of any suitable stretchy material.

The pillowcase 100 resulted by joining the top fabric layer 102, the bottom fabric layer 104, and the intermediate fabric layer 106 includes a body portion, two side arms, an interior cavity accessible through a first closure means 116. The first closure means 116 is preferably disposed at the opening provided on edge 114 of the body portion through which the interior cavity may be accessible. The body portion of the pillowcase 100 defines a curved portion of the pillowcase 100 that surrounds user's neck from rear side, and the two side arms refers to U shaped portion that surrounds the user's neck from two sides of user's neck and preferably meet in front of the user's neck and are secured to each other using some fastener means such as but not limited to snaps 110 (a pair of snaps including a male part and a female part that snaps together), a buckle or a hook and loop fastener. The neck pillowcase 100 may also include some fastener 112 preferably but not limited to a buckle or a hook and loop fastener or a pair of snaps that can be used for hanging or attaching the pillowcase 100 against some external surfaces, for example, when the pillowcase 100 is in use embodying the neck pillow 120 inside then the neck pillow can be hung on to the buckle of a luggage bag that passengers usually carry during their travel. In an example, the fastener 112 is shown to be present on the side of the pillowcase 100. In some other examples, the fastener 112 may be present in some other location. According to some embodiment, either one of the snaps 100 (the male part or the female part) present on two arts may be configured to have respective mating snap on the same side, so that fastener 112 and snaps 110 feature can be combined together.

Figure 2:
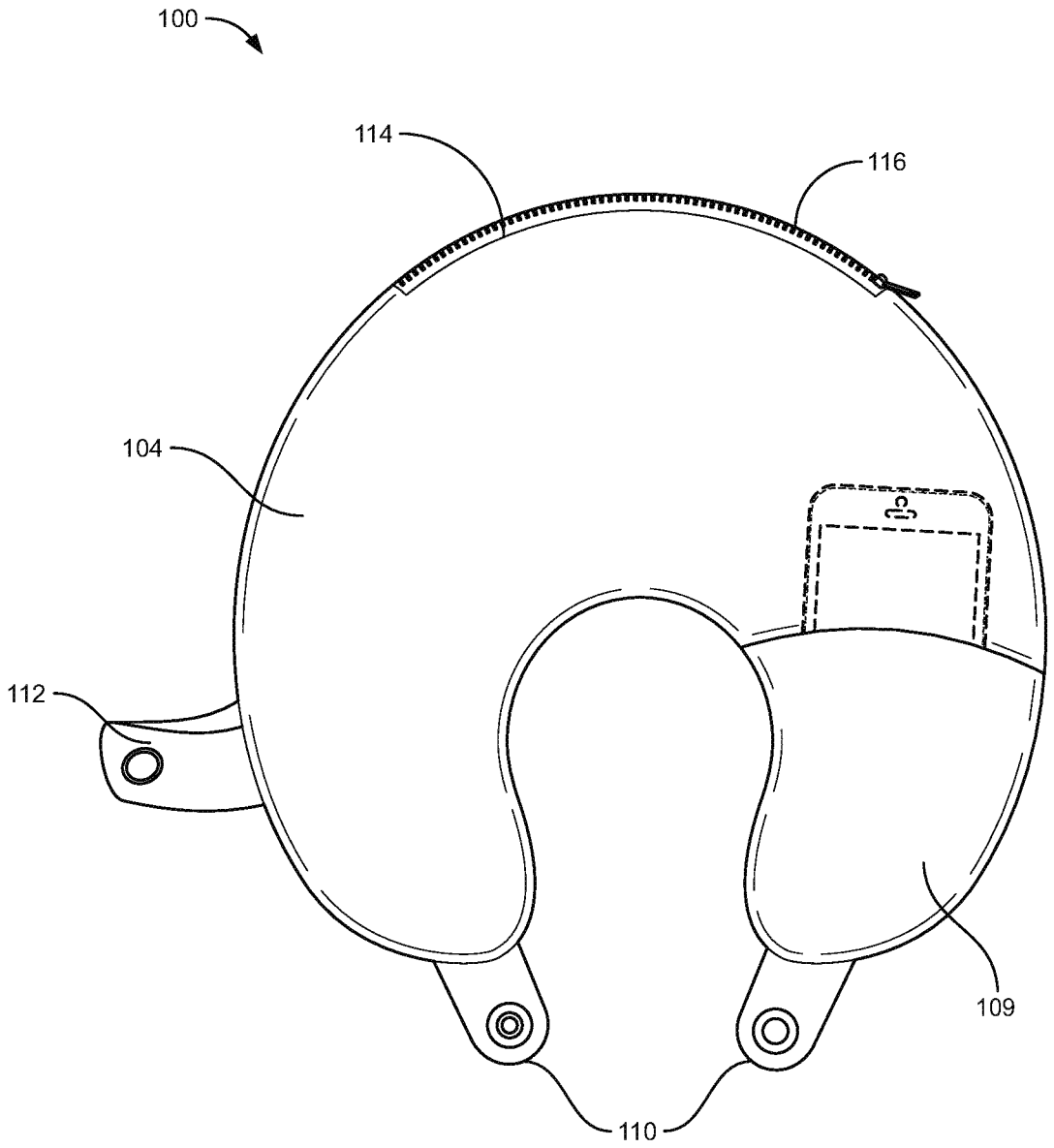
FIG. 2 illustrates a bottom or underside view of the improved neck pillowcase without a neck pillow inside, in accordance with an exemplary embodiment of the present invention.
Figure 6A:
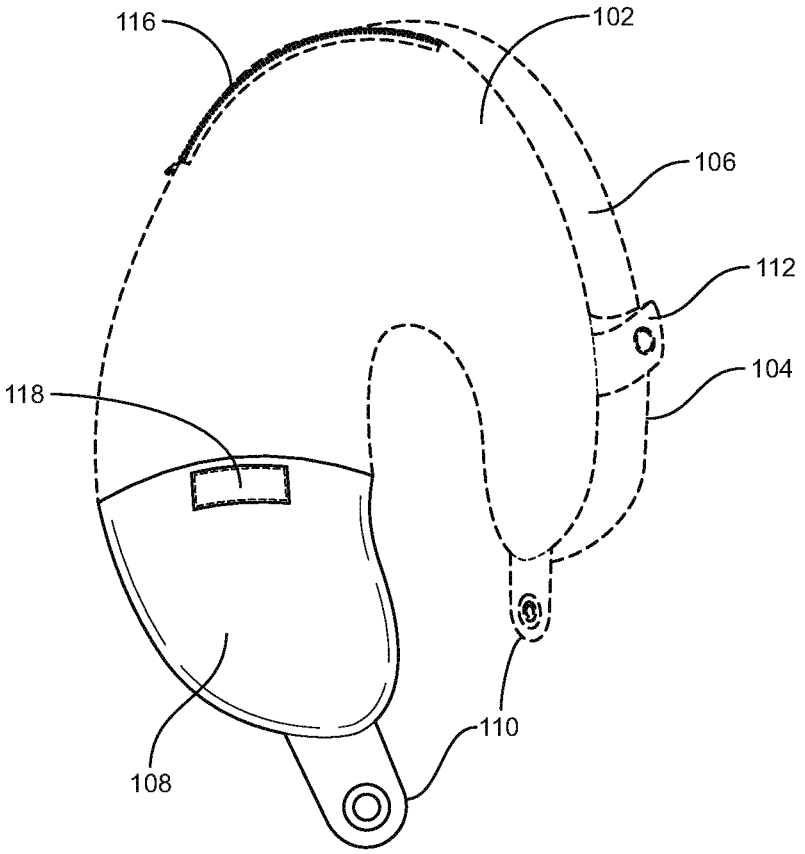
FIG. 6A-FIG. 6B illustrates portability of the improved neck pillowcase shown in FIG. 1.
Figure 6B:
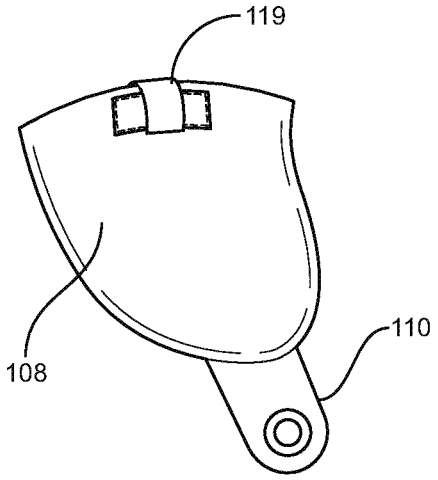

The pillowcase 100 further includes at least one flap 108 configured externally on at least one of the two side arms either on the top fabric layer 102 or the bottom fabric layer 104. The flap 108 is used to facilitate portability for carrying the pillowcase 100, when the pillowcase 100 is not in use. The flap 108 configured on one of the side arms can receive a portion of the pillowcase 100, particularly the body portion and other side arm when the pillowcase 100 is not in use to facilitate portability as shown in FIGS. 6A-6B. According to another example, the at least one flap 108 may also be used to hold different objects such as cell phones, ipods, and the like as shown in FIG. 2.

Referring further to FIGS. 6A-6B, the portion of the pillowcase 100 other then the arm over which the flap 108 is configured can be foldably inserted inside an interior cavity of the flap 108. In another embodiment, the portion of the pillowcase 100 other then the arm over which the flap 108 is configured can be rolled and inserted inside the flap 108 to pack the pillowcase 100 inside the flap 108 and give a sense of the pillowcase 100 being a portable hand pouch that can be carried by users preferably passengers during their travel. The flap 108 is preferably sewed along the peripheral edges of the arm over which the flap 108 is mounted. Although, two flaps 108, 109 are shown in FIG. 1-2 on the top fabric layer 102 and the bottom fabric layer 104 on one of the two side arms, it should be understood that a maximum of four flaps can be provided on either sides of both the arms for enabling users to selectively use any of the flaps 108 either for holding the objects or for portability. Also, it should be understood that, if more than one flap 108 is used on the pillowcase 100 then the flaps may be made identical in size or the flaps may be configured in different sizes (as shown in FIG. 1 and FIG. 2, the flaps 108 and 109 differ in size). Based on an example, if any of the flaps is configured to be used for holding different objects then based on the intention for holding the objects, the flap's size can be determined. For example, as specifically shown in FIG. 2, the pillowcase 100 may include a flap 109 configured externally on at least one of the two side arms either on the top fabric layer 102 or the bottom fabric layer 104. As shown, the flap 109 may be configured just opposite to the flap 108 for holding different objects, such as but not limited to cell phone. The flaps 108 or 109 may preferably be made of materials used for the top fabric layer 102, the bottom fabric layer 104, and the intermediate fabric layer 106. When the flap 109 is configured specifically for holding and securing the objects then it is desired that the flap be made of fabric material elastic in nature to tightly hold the objects placed therein.

Figure 3:
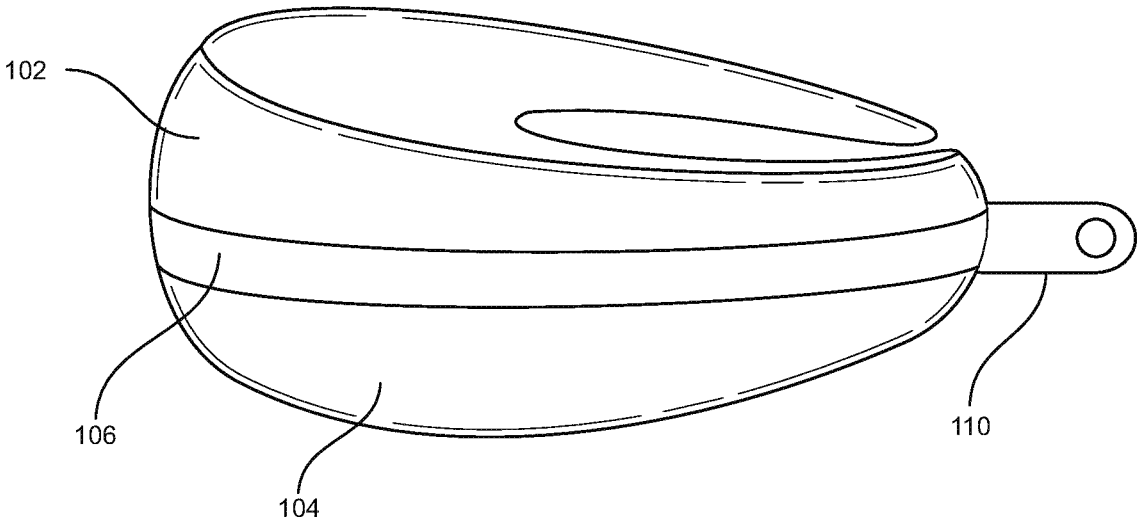
FIG. 3 illustrates a side view of the improved neck pillowcase with a neck pillow embodied therein, in accordance with an exemplary embodiment of the present invention.

Referring to FIG. 3 illustrates a side view of the improved neck pillowcase 100 with a neck pillow embodied therein, in accordance with an exemplary embodiment of the present invention. As shown, the pillowcase 100 can embody the neck pillow or cushion pillow inside for use. The neck pillow will be inserted inside the interior cavity of the pillowcase 100 by operating the closure means 116 shown in FIG. 1. The neck pillowcase 100 is shown in fully extended position with the neck pillow inside in FIG. 3, where the intermediate fabric layer 106 is sewn together with the top fabric layer 102 and the bottom fabric layer 104 at the perimeter edges. The intermediate layer 106 according to the invention is an elastic fabric layer being able to provide stretchability, such as to allow the pillowcase 100 to expand and accommodate the neck pillows that might be slightly bigger in size/dimension compared to standard sized neck pillows that the neck pillowcase 100 of the proposed invention can normally accommodate.

Figure 4:
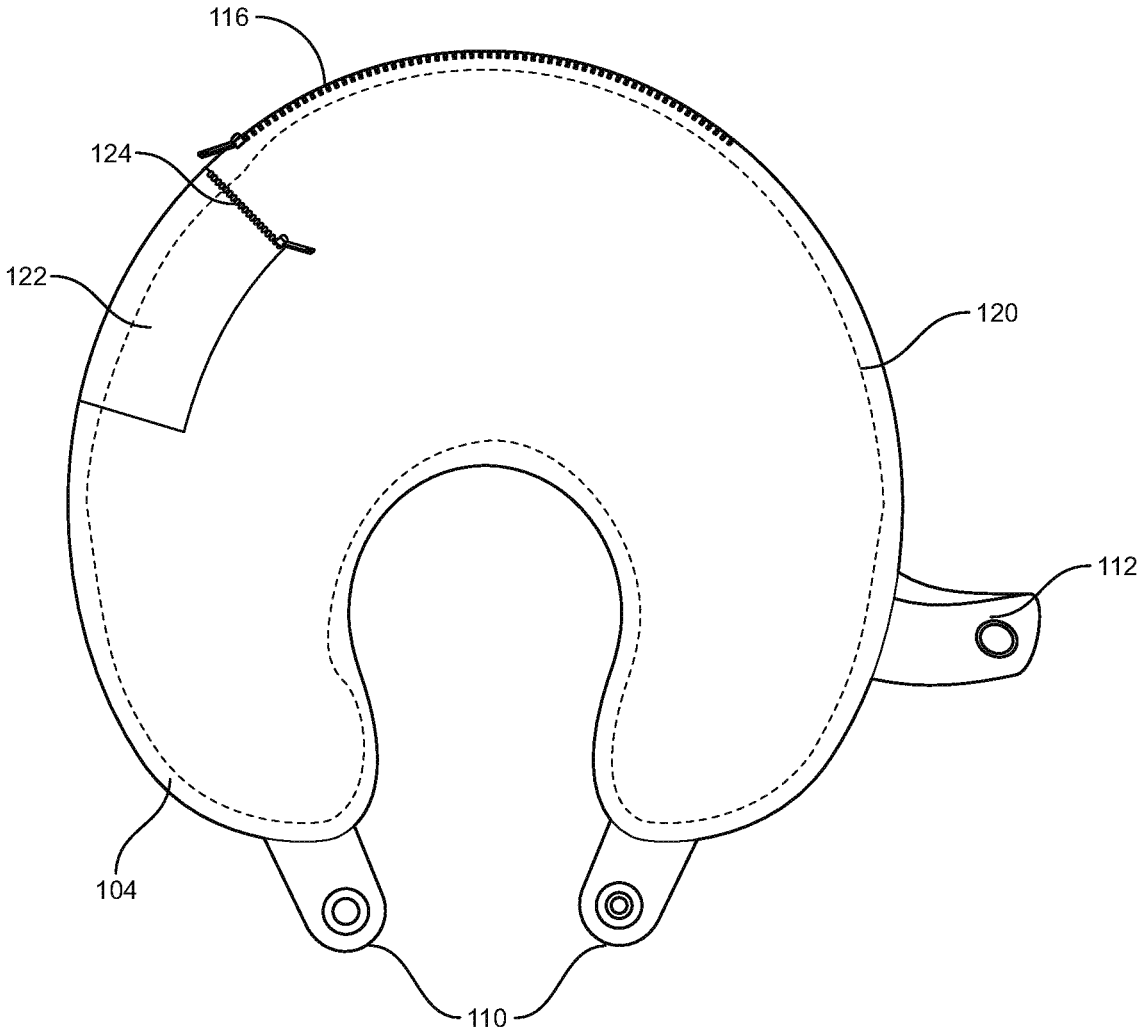
FIG. 4-FIG. 5 illustrates internal views of the improved neck pillowcase with one or more internal pockets, in accordance with an exemplary embodiment of the present invention.
Figure 5:
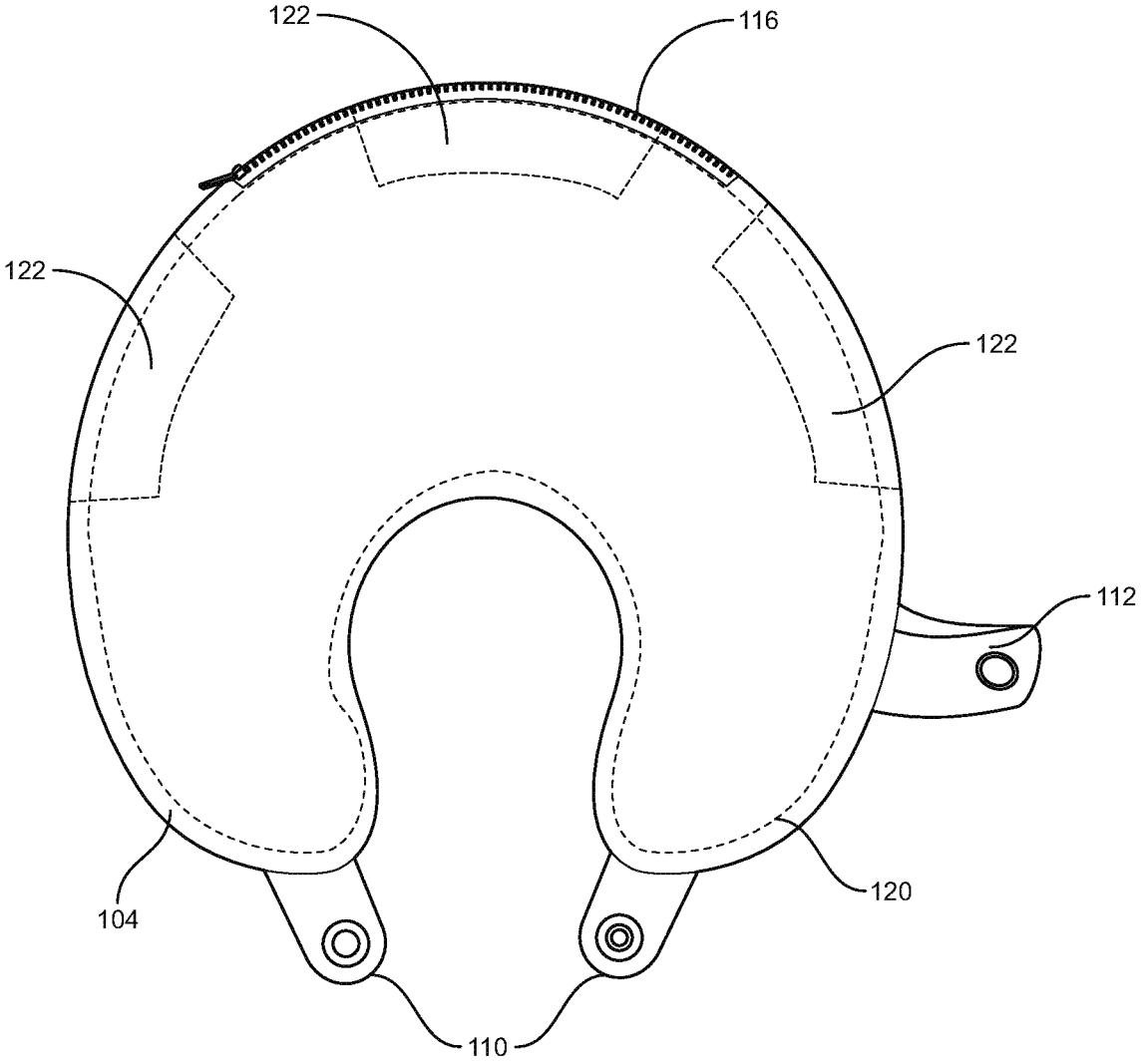

Referring to FIGS. 4-5 illustrates internal views of the improved neck pillowcase with one or more internal pockets, in accordance with an exemplary embodiment of the present invention. As shown, the pillowcase 100 provides users with one or more internal pockets 122 that would be easily accessible through the first closure means 116 of the pillowcase 100. The internal pockets 122 will be disposed inside the interior cavity of the pillowcase 100.

Particularly, as shown in FIG. 4 where only one internal pocket 122 is shown, the pocket 122 is disposed along edge of the curved body portion substantially to the right and near to the first closure means 116 so that the user can easily access the internal pocket 122 through the closure means 116. The internal pocket 122 can hold one or more objects preferably jewelry items, or other valuable belongings. The scope of the invention is not limited to the size and the shape of the internal pocket 122 and nature of the objects the pockets 122 can hold. The internal pocket 122 may include a second closure means 124 preferably but not limited to a zipper 124 and the like to secure the objects placed inside the pocket 122.

FIG. 5 illustrates an embodiment of the present invention, wherein possibility of having multiple internal pockets 122 is illustrated. As shown, the pockets 122 may be disposed or configured onto the right side and near to the closure means 116, or just centrally located next to the closure means 116, or onto the left side and near to the closure means 116.

Referring further to the FIGS. 4-5, consider a scenario when the pillowcase 100 includes the neck pillow or neck cushion 120 inside (as shown in dotted lines), under such conditions, the internal pockets 122 can easily tuck in the region between the top fabric layer 102 and upper surface of the neck pillow 120. According to another embodiment the pockets 122 may also be configured such that when the pillowcase 100 is embodying the neck pillow 120 inside then the internal pockets 122 can easily tuck in the region between the bottom fabric layer 102 and lower surface of the neck pillow 120. Such pockets 122 can be handy for the users especially passenger when they are traveling and want to secure some valuable belongings next to their eyes. According to the embodiment of the present invention, the internal pockets 122 may comprise of the same fabric material used for the top fabric layer 102, or the bottom fabric layer 104 or may optionally be made of different fabric material then used for the top and bottom fabric layers 102, 104.

Referring back to FIG. 6A-6B which shows the utility of the flap 108 configured on one of the side arms of the pillowcase 100. As discussed above, the flap 108 can receive the body portion and other side arm of the pillowcase, when the pillowcase 100 is not in use to facilitate portability. The flap 108 according to the preferred embodiment may be provided with some fastener means preferably but not by way of limitation a Velcro® means 118, 119 to securely hold the portion of the pillowcase 100 foldably or rollably inserted inside the interior region of the flap 108. First part or the male part 118 of the Velcro® means may be configured on the outer surface of the flap 108, whereas the second part or the female part 119 in the form of a Velcro® strap may be configured onto the bottom fabric layer 104 on its exterior face. When the flap 108 is in use i.e., when the flap 108 holds the portion of the pillowcase 100 foldably or rollably inserted inside the interior region of the flap 108 then the Velcro® strap 119 may be coupled with the male part 118 to ensure closure of the opening of the flap 108. This behavior of the flap 108 to hold the most of the part of the pillowcase 100 therein and give a sense of pillowcase 100 being a hand pouch that provides portability to the users especially passengers who often need to travel and carry neck pillows and neck pillowcases for the neck pillows.

Figure 7:
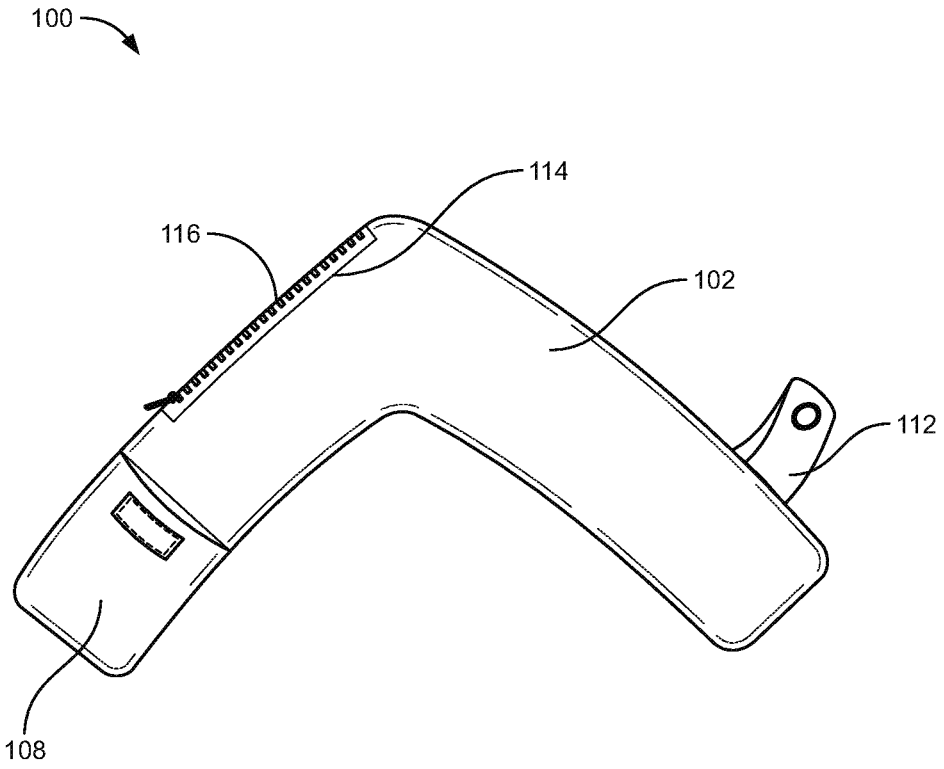
FIG. 7 illustrates a top view of an improved neck pillowcase without a neck pillow inside, in accordance with another exemplary embodiment of the present invention.

Referring to FIG. 7 illustrates a top view of the improved neck pillowcase without a neck pillow embodied therein, in accordance with another exemplary embodiment of the present invention. As shown, a V shaped neck pillowcase 100 is illustrated. The V shaped neck pillowcase 100 can be considered as an alternative design for the neck pillowcase 100 and can embody same design features explained above with respect to the U shaped neck pillowcase in FIGS. 1-6.

The illustrations of arrangements described herein are intended to provide a general understanding of the structure of various embodiments, and they are not intended to serve as a complete description of all the elements and features of apparatus and systems that might make use of the structures described herein. Many other arrangements will be apparent to those of skill in the art upon reviewing the above description. Other arrangements may be utilized and derived therefrom, such that structural and logical substitutions and changes may be made without departing from the scope of this disclosure. Figures are also merely representational and may not be drawn to scale. Certain proportions thereof may be exaggerated, while others may be minimized. Accordingly, the specification and drawings are to be regarded in an illustrative rather than a restrictive sense.

The preceding description has been presented with reference to various embodiments. Persons skilled in the art and technology to which this application pertains will appreciate that alterations and changes in the described structures and methods of operation can be practiced without meaningfully departing from the principle, spirit and scope.

What is claimed is:

1. An improved neck pillowcase for a neck pillow, comprising:

a top fabric layer;

an intermediate fabric layer;

a bottom fabric layer, wherein the top fabric layer and the bottom fabric layer are joined together with the intermediate fabric layer at two perimeter edges of the intermediate fabric layer to form a body portion, two side arms, an interior cavity accessible through a first closure means embodied near the body portion of the improved neck pillowcase;

one or more pockets configured internally and proximal to the first closure means within the body portion of the improved neck pillowcase for holding one or more objects, wherein each of said one or more pockets comprises of a second closure means; and at least one flap configured externally on at least one of the two arms and provided with a first fastener means to securely hold a portion of the improved neck pillowcase rollably inserted inside an interior region of the at least one flap.

2. The improved pillowcase of claim 1, further comprising at least one fastener used for attaching the improved neck pillowcase on one or more external surfaces.

3. The improved pillowcase of claim 1, wherein the body portion of the improved neck pillowcase defines a curved portion that surrounds user's neck from rear side, and the two side arms defines a U shaped portion that surrounds the user's neck from two sides of user's neck and meet in front of the user's neck.

4. The improved pillowcase of claim 3, wherein the two side arms defining the U shaped portion are secured in front of the user's neck using a second fastener means.

5. The improved pillowcase of claim 4, wherein the second fastener means comprises of a pair of snaps, a buckle means or a hook and loop fastener.

6. The improved pillowcase of claim 1, wherein the intermediate layer includes an elastic fabric layer stretchable in nature such as to allow the improved neck pillowcase to expand and accommodate the neck pillow.

7. The improved pillowcase of claim 1, wherein the first closure means is disposed at an opening provided on edge of the body portion through which the interior cavity of the improved neck pillowcase is accessible.

8. The improved pillowcase of claim 1, wherein the at least one flap holding the portion of the improved neck pillowcase packed therein provides portability for carrying the improved neck pillowcase.

9. The improved pillowcase of claim 1, wherein the at least one flap is made of fabric layer stretchable or non-stretchable in nature.

10. The improved pillowcase of claim 1, wherein the first closure means and the second closure means comprises of a zipper.

11. The improved pillowcase of claim 1, wherein the at least one flap is further configured for holding the one or more objects.

12. The improved pillowcase of claim 1, wherein the first fastener means is a Velcro®.

* * * * *